United States Patent [19]

Plissonneau et al.

[11] Patent Number: 4,646,929

[45] Date of Patent: Mar. 3, 1987

[54] LIFE-SAVING BASKET

[75] Inventors: Bernard P. Plissonneau; René J. Poggi, both of Bouches-du-Rhône, France

[73] Assignee: Societe Nationale Industrielle et Aerospatiale, Paris, France

[21] Appl. No.: 758,242

[22] Filed: Jul. 24, 1985

[30] Foreign Application Priority Data

Aug. 1, 1984 [FR] France ..... 84 12194

[51] Int. Cl.[4] ..... B65D 6/00; B63C 9/00

[52] U.S. Cl. ..... 220/19; 403/396; 441/80

[58] Field of Search ..... 441/80, 83, 86, 87; 244/137 P; 220/19; 182/142; 403/347, 396; 5/81 R, 82, 85

[56] References Cited

U.S. PATENT DOCUMENTS

| | | | |
|---|---|---|---|
| 1,950,376 | 3/1934 | Alexander | 220/19 X |
| 2,333,869 | 11/1943 | Larkin | 403/396 |
| 2,519,376 | 8/1950 | Jennings | 441/80 |
| 3,133,660 | 5/1964 | Roberts | 220/19 |
| 3,338,466 | 8/1967 | Hare et al. | 220/19 X |
| 3,343,189 | 9/1967 | Pollard et al. . | |
| 3,601,824 | 8/1971 | Bradford | 5/82 |
| 4,046,261 | 9/1977 | Yake | 220/19 X |

FOREIGN PATENT DOCUMENTS

| | | | |
|---|---|---|---|
| 0546102 | 6/1942 | United Kingdom | 441/80 |

*Primary Examiner*—Sherman D. Basinger
*Assistant Examiner*—Paul E. Salmon
*Attorney, Agent, or Firm*—Armstrong, Nikaido, Marmelstein & Kubovcik

[57] ABSTRACT

A life-saving basket and equipment handling device having a plurality of parallel horizontal frame elements connected to at least two U-shaped hoops arranged in planes perpendicular to the planes of the frame elements to form mesh sides of the basket, the bottom of the basket being provided with longitudinal elements forming supports. Each hoop is connected to each frame at each point of intersection by a separate connecting element. The free ends of each hoop and those of two handle elements of inverted U-form are joined by a top edge frame which includes two longitudinal members on which are engaged, spaced by distance pieces, the free ends of the hoops and the handle elements, and two transverse members connected to the ends of the longitudinal members.

7 Claims, 11 Drawing Figures

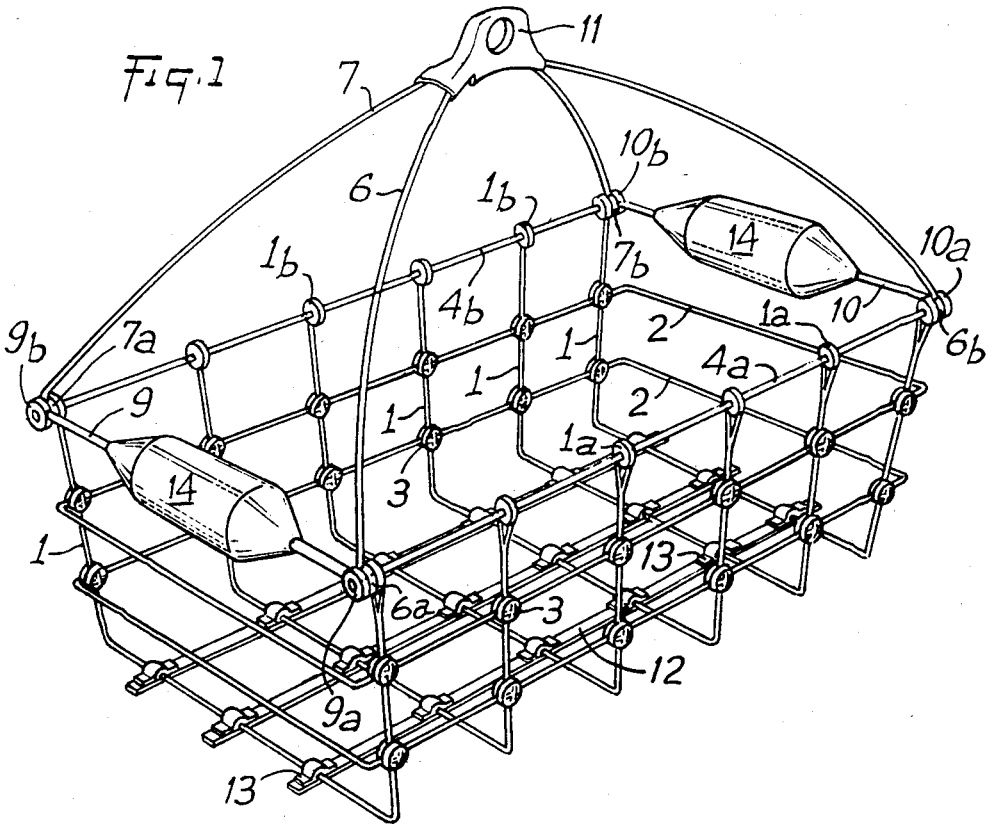
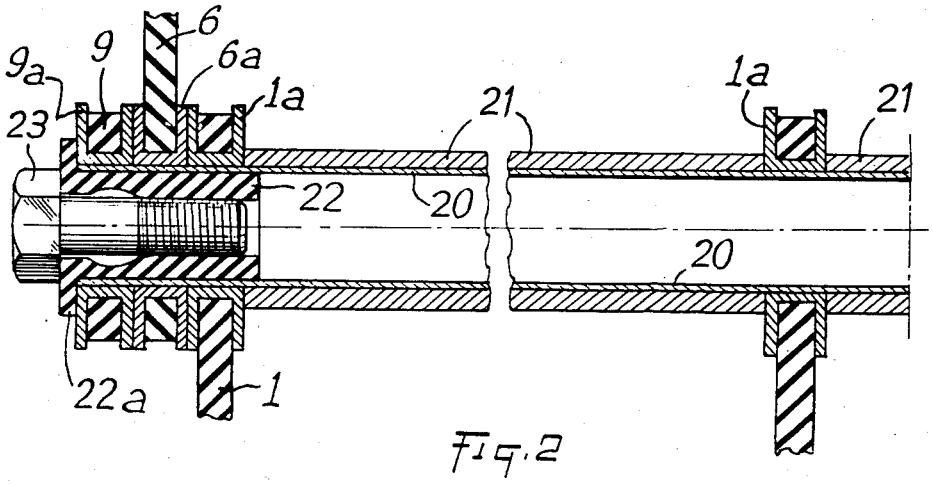
Fig. 2

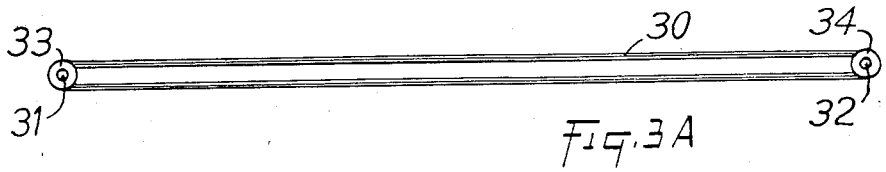
Fig. 3A
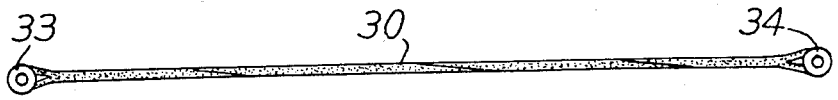
Fig. 3B
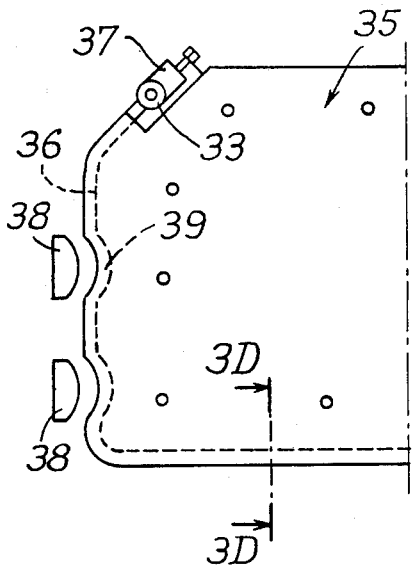
Fig. 3C
Fig. 3D
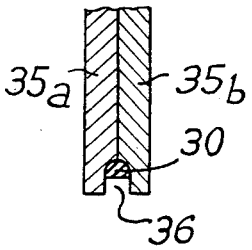
Fig. 4A
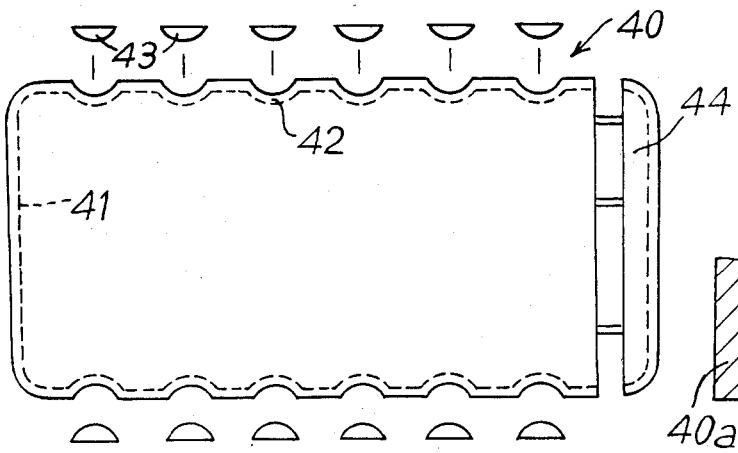
Fig. 4B
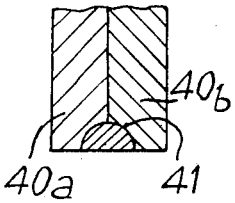

LIFE-SAVING BASKET

BACKGROUND OF THE INVENTION

The present invention relates to a basket, particularly but not exclusively for life-saving use at sea, which can be used from a boat or a helicopter, and more generally to a handling equipment basket for use in a marine medium.

Most of the existing baskets are made from wires soldered together to give a mesh structure equipped with two gripping handles joined by their central section by means of a non-detectable connecting component provided with a hoisting eye. These non-flexible, non-collapsible baskets often cause excessive obstruction, which restricts their handling and storage. In addition, being metallic, they need constant maintenance to limit the intense corrosion to which they are subjected. They are furthermore very heavy and can undergo permanent deformation under the action of load and shock. Finally, they are made in one piece, and their repair requires renewal operations which cannot easily be carried out.

SUMMARY OF THE INVENTION

According to this invention there is provided a basket comprising a plurality of parallel planar frame elements and at least two hoops of open-loop form so as to have two free ends, said frames extending in planes substantially perpendicular to the planes of the hoops to form with the hoops mesh sides of the basket, said frame elements extending closely adjacent the hoops to form points of intersection in said sides of the basket, a connecting element located at each point of intersection of each hoop with each frame element and connecting such hoop to such frame element, two handle elements of open loop form so as to have two free ends, and a top edge frame comprising two longitudinally extending side elements and two transversely extending end elements, the two side elements being respectively detachably connected at spaced locations lengthwise thereof to the two free ends of each hoop and being further detachably connected to the two free ends of each of the handle elements and the respective end elements of the top edge frame.

Each end of each hoop, handle element, and end element may conveniently be shaped into an eyelet through which the said side elements extend.

Preferably, each hoop and each handle element is made by shaping a twisted hank of high-strength fibres impregnated with a polymerisable resin, the hank being provided at each end with an insert defining the eyelet, the hank being shaped and polymerised in a mould.

Each frame is preferably likewise made of a composite material based on fibres and a polymerisable resin, and is produced by winding these fibres preimpregnated with resin around a mould and polymerising the resin in this shape.

It is moreover advantageous to make each of said connecting elements in the form of two half shells, having on mutually opposite surfaces the half-impression at a point of intersection, these half-shells being secured together by glueing or soldering to enclose the parts of the hoop and frame at their point of intersection.

The fixing of the handle elements, the hoops and the end elements of the top edge frame on to the side elements of that frame is effected by means of tubular spacers and tightening means or by stops located at the ends of the said bars, to immobilise the various components.

BRIEF DESCRIPTION OF THE DRAWINGS

The invention will be better understood from the following description of an embodiment by way of example which will also reveal advantages and secondary characteristics of the invention.

In the attached drawings,

FIG. 1 is a view of a basket according to the invention,

FIG. 2 illustrates the connection of the hoops and handle elements of the basket to the elements forming the top edge frame, FIGS. 3A, 3B, 3C and 3D illustrate schematically the different phases of the production of a hoop or handle, FIGS. 4A and 4B illustrate a mould for producing a frame of the basket.

DETAILED DESCRIPTION OF A PREFERRED EMBODIMENT

Figure 5:
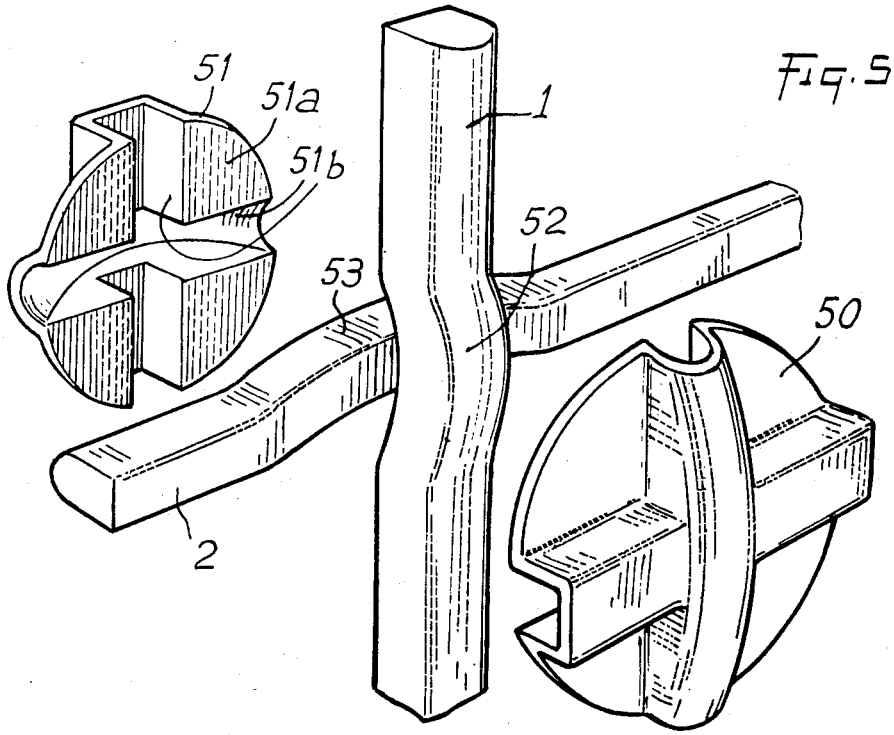
FIG. 5 is a diagram of the connecting element used to join each hoop to the frames.

Referring first to FIG. 1, this shows a basket according to the invention consisting of a plurality of transverse hoops 1 parallel to one another, connected to two frames 2 which extend in the parallel planes perpendicular to the planes containing the hoops 1. The hoops 1 and the frames 2 are connected at their points of intersection (here numbering 24) by means of connecting elements 3. The free ends 1*a* and 1*b* of the hoops 1 are provided with a ring or an eyelet allowing a longitudinal bar 4*a* to pass through the ends 1*a* and a longitudinal bar 4*b* to pass through the ends 1*b*. On the ends of each of these bars 4*a* and 4*b* are also threaded the end eyelets 6*a* and 6*b* of a handle 6 in the case of bar 4*a*, and eyelets 7*a* and 7*b* of a handle 7 in the case of bar 4*b*, as well as end eyelets 9*a*, 10*a* and 9*b*, 10*b* of the transverse bars 9 and 10, which form an upper collapsible frame of the basket with the bars 4*a* and 4*b*. The central sections of handles 6 and 7 are equipped with a connecting component which provides a hoisting eye 11 for the basket.

Supports on the bottom of the basket in the form of battens 12, made of wood, a synthetic material or stainless steel, one attached to the hoops by staples 13 and, for example, self-tapping screws, and floats 14 are mounted on the transverse bars 9 and 10.

The means which enable assembly and connection of the elements of the basket and the way in which they work together with these will be explained with reference to the remaining figures of the drawings.

FIG. 2 illustrates the way in which the hoops 1, the handle 6 and the transverse bar 9 co-operate with the bar 4*a*. This assembly is to be found at the four corners on the top of the basket.

Thus the bar 4*a* in fact consists of a tube 20 passing through the eyelets 9*a* of the bar 9, 6*a* of the handle 6 and 1*a* of the hoops 1. Between two consecutive hoops 1, the tube 20 carries tubular spacers 21 to keep the hoops apart from one another. It can be seen that the tube 20, like the spacers 21, can be made either of stainless steel or of a composite material, in particular by draping or winding.

An insert 22 having a shoulder 22*a* is located at the end of the tube 20 and constitutes a stop against axial displacement of the components stacked on the tube. This insert can be held fast in the tube by a screw 23, insertion of which leads to radial expansion of the insert, which is made of a suitable material, and thus ensures locking of the insert in the tube. This arrangement allows immobilisation of the stack, whilst keeping at least certain of the elements thereof, such as the handle 6, freely rotatable around the tube 20. It is of course possible to provide other means of axial immobilisation of the stack on the tube, such as, for example, a shoulder attached to one of its ends and a simple screw engaged in an internal thread at the other end of the tube 20.

The handles, the hoops, the frames and the transverse bars of the basket can be made of any appropriate material, but in one of the most advantageous embodiments of the invention, these elements are made of a composite material by a production process illustrated schematically by FIGS. 3A and 3D for those of these elements which are not in the form of closed loops and FIGS. 4A and 4B for the frames.

The example in FIGS. 3A to 3D relates in particular to the hoops, but can also easily be applied to the handles and indeed to the transverse bars.

FIG. 3A shows schematically a hank 30 of fibres or ribbon of a reinforcing material, such as glass, carbon, or the aromatic polyamide known commercially as KEVLAR, impregnated with a resin which can be polymerised, for example, under the influence of heat. Several impregnation techniques can be used. However, impregnation of the winding in situ just before production of the hank by passing the bundle of fibres or ribbon over a mixing roller in a resin bath is preferred. The hank 30 is produced by winding the abovementioned fibres around two shafts 31 and 32, which carry the rings 33, 34 forming the abovementioned eyelets. The axles 31 and 32 are carried by the head of a revolving machine, not shown, the axis of rotation of which is located at the centre of the distance separating the two axles, it being possible for this distance to be adjusted as a function of the length of the hank to be obtained.

FIG. 3B shows that after the hank 30 has been produced, it is twisted slightly on itself (by relative rotation of one end with respect to the other by two turns, for example) to promote intimate contact of the coated fibres.

FIGS. 3C and 3D show schematically a mould 35 consisting of two plates 35*a*, 35*b* disposed one against the other, the outer edge of the mould being provided with a groove 36 into which the twisted hank 30 is placed. The grooved contour of the mould 35 has a shape identical to that to be given to the hank to form a handle or a hoop. A device 37 for tensioning the hank is attached to each of two rings 33 and 34, whilst external deforming elements 38 on the mould are provided opposite the recesses 39 in the mould for shaping the zones on the hoop at the points of intersection between the hoop and the frames, such as are shown clearly in FIG. 5.

It can thus be seen that production of a hoop comprises placing the hank 30 into the groove 36 of the mould 35, tensioning the hank by means of the device 37, shaping the hank 30 locally with the elements 38 to correspond with the contour of the base of the groove 36, and then initiating polymerisation of the resin. The component thus obtained is removed by separating the two plates 35*a*, 35*b*. The handles 6 and 7 are formed on a similar mould which does not have recessed zones or elements 38. As regards the transverse bars, these can be produced by simple polymerisation of the twisted hank of FIG. 3B, kept under tension.

FIGS. 4A and 4B show schematically a mould 40 for the production of the closed structures of which the basket consists, that is to say the frame 2. This mould consists of two plates 40*a* and 40*b*, on the outer edge of each of which is located a half-groove such that when the plates are joined, the mould carries a peripheral groove 41 the contour of which corresponds to the shape of the component to be moulded. It can be seen that the contour includes recessed zones 42 for the same reasons as those of 39 in FIG. 3C, into which the material is forced by means of deforming elements 43, which form part of the moulding installation and can slide with respect to the mould. Finally, each of the plates 40*a*, 40*b* has an end piece, such as 44, which can be extended and retracted in a manner such that the length of the groove 41 can be varied.

To produce a frame for example, a quantity of fibres or ribbon impregnated with resin is wound around the mould 40 in the groove 41 in the starting position of the sections 44 (as shown in FIG. 4A). This winding is then forced into the complete contour of the groove 41 by means of the deforming elements 43, whilst allowing the sections 44 to retract to enable the material to fill the recessed zones 41. Polymerisation of the resin is then intiated, and the frame is released from the mould by separating the two plates 40*a*, 40*b*.

FIG. 5 is a detailed view of a connecting element 3 between a hoop 1 and a frame 2 at their point of intersection. This connecting element here consists of two half-shells 50 and 51, which are preferably made of a thermosetting material and which have a planar front surface 51*a*, in which is formed a half-impression 51*b* of the shape at the point of intersection. The deflection zones 52 of the hoop 1 and 53 of the frame 2 are made entirely identical, so that a single form of the half-shell can be used on both sides of the point of intersection, one being rotated through 90° with respect to the other on assembly. The half-shells 50, 51 are thus applied with their surfaces, such as 51*a*, facing one another in a manner such that they enclose in the impression thus enclosed, the zones 52 and 52. They can be secured together by an convenient means, such as soldering and/or glueing or clip means.

Figure 6A:
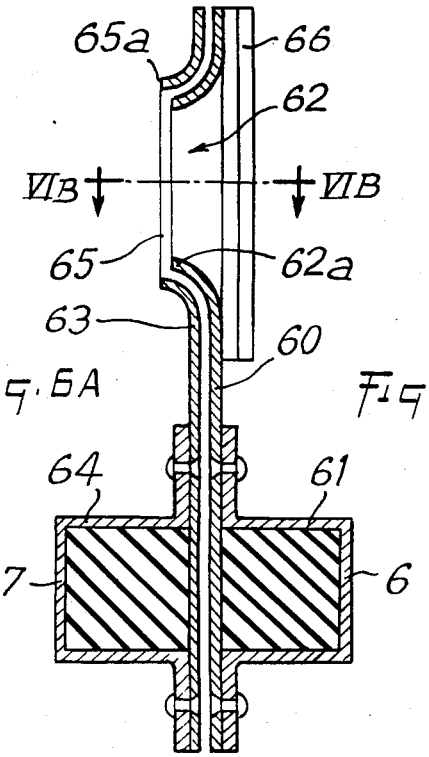
FIGS. 6A and 6B are two sections along lines VI A—VI A and VI B—VI B showing a detail of the basket of FIG. 1.
Figure 6B:
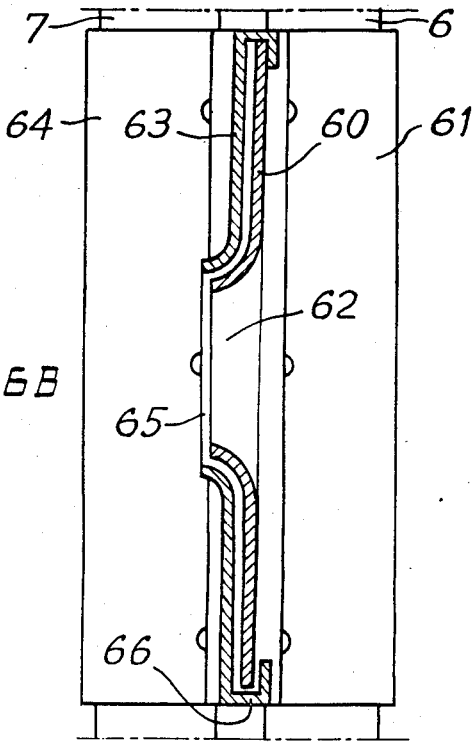

Finally, FIGS. 6A and 6B show a section through the means attached to the central section of the handles 6 and 7 which on the one hand enables these handles to be joined to keep them in the erect position and on the other hand provides a hoisting eye for the basket. These means here consist of a plate 60 fixed to the handle 6 by a bracket 61 riveted to the plate and stuck to the section of the handle which it surrounds. This plate has an orifice 62, the edges 62*a* of which are flanged to form a type of skirt on one side of the plate. The handle 7 is likewise provided with a plate 63 fixed to it by a bracket 64 and having an orifice 65, the edges 65*a* of which are orientated in the same direction as those 62*a* of the orifice 62. In addition, the plate 63 has two lateral edges perpendicular to the handle 7, which constitute a slide 66 for the corresponding edges of the plate 60. The flanged edges 62*a* of the orifice 62 thus slide under force (the intensity of which will depend on their height), until they just click into the orifice 65 of the plate 63. The orifice 62 accommodated in the orifice 65 constitutes a hoisting eye for the basket, the rounded flanged edges being a means of reinforcing this orifice.

From the above description, it can be seen that the basket shown has several advantageous features, both from the point of view of its production and from the point of view of its use and maintenance. In fact, its design using modular elements allows rational production of all its component materials for the large majority of them, these materials giving it improved resistance and a lower weight than the metallic materials previously used. As regards use, there is provided a collapsible basket, the handles of which are flexible, which is not susceptible to corrosion and of which maintenance is non-existent or at least rapid, by standard replacement of the component which has deteriorated, and, finally, which is easier to handle and store due to the fact that it is lighter in weight and takes up less space.

An interesting application for the invention is in the field of life-saving and equipment handling in a marine medium.

We claim:

1. A basket comprising a plurality of parallel planar frame elements and at least two hoops of open-loop form so as to have two free ends, said frames extending in planes substantially perpendicular to the planes of the hoops to form with the hoops mesh sides of the basket, said frame elements extending closely adjacent the hoops to form points of intersection in said sides of the baskets, a detachable connecting element located at each point of intersection of each hoop with each frame element and connecting such hoop to such frame element, two handle elements of open loop form so as to have two free ends, and a top edge frame comprising two longitudinally extending side elements and two transversely extending end elements, the two side elements being respectively detachably connected at spaced locations lengthwise thereof to the two free ends of each hoop and being further detachably connected to the two free ends of each of he handle elements and the respective end elements of the top edge frame, both ends of each hoop, each handle element, and each end element of the top edge frame being in the form of eyelets through which the said side elements of the top edge frame extend, each hoop comprising a first shaped hank of resin-bonded fibres incorporating at each end of the hank an insert defining the eyelet, each handle element comprising a second shaped hank of resin-bonded fibers incorporating at each end of the hank an insert defining the eyelet.

2. A basket according to claim 1, wherein the hoops and frame elements are preformed with joggled portions at said points of intersection, the joggled portions at each point of intersection interfitting with each other.

3. A basket according to claim 2, wherein each of said connecting elements comprises two half-shells made from a plastics material and having mutually facing surfaces, each of which surfaces has formed in it a half-impression of a hoop and a frame element at the point of intersection, said half-shells being secured together over said interfitting joggled portions.

4. A basket according to claim 1, comprising tubular spacers mounted on said side elements between adjacent frame elements, and detachable tightenable components engaging said side elements for preventing disengagement of the eyelets of the frame elements, handle elements and end elements from the side element extending therethrough.

5. A basket according to claim 1, wherein the two handle elements are pivotally mounted on the side elements of the top edge frame, and comprising supports attached centrally to the respective handle elements and connected together, said supports having mutually aligned apertures together constituting a hoisting eye.

6. A basket according to claim 1, further comprising supporting battens secured to adjacent portions of all of the hoops remote from the top edge frame.

7. A basket according to claim 1, wherein the two handle elements are pivotally mounted on the side elements of the top edge frame and the two handle elements are connected together in their central part by two plates each fast with a handle and having an orifice with flanged edges, said orifices being in correspondence with two handle elements are joined to keep them in the correct position and provides a hoisting eye for the basket.

* * * * *

UNITED STATES PATENT AND TRADEMARK OFFICE

CERTIFICATE OF CORRECTION

PATENT NO. : 4,646,929

DATED : March 3, 1987

INVENTOR(S) : BERNARD P. PLISSONNEAU et al

It is certified that error appears in the above-identified patent and that said Letters Patent is hereby corrected as shown below:

On the cover page, Item [73], change "Societe Nationale Industrielle et Aerospatiale" to -- Aerospatiale, Societe Nationale Industrielle --.

Signed and Sealed this

Twenty-fifth Day of August, 1987

*Attest:*

DONALD J. QUIGG

*Attesting Officer*

*Commissioner of Patents and Trademarks*